US010863833B2

(12) United States Patent
McLees

(10) Patent No.: US 10,863,833 B2
(45) Date of Patent: Dec. 15, 2020

(54) CHECK STAND CONVEYOR BELT BOTTOM EXTRACTED SHOPPING BIN

(71) Applicant: Donald James McLees, Everett, WA (US)

(72) Inventor: Donald James McLees, Everett, WA (US)

( * ) Notice: Subject to any disclaimer, the term of this patent is extended or adjusted under 35 U.S.C. 154(b) by 73 days.

(21) Appl. No.: 16/350,028

(22) Filed: Sep. 14, 2018

(65) Prior Publication Data

US 2020/0085213 A1 Mar. 19, 2020

(51) Int. Cl.
*A47F 9/04* (2006.01)
*B65D 43/20* (2006.01)

(52) U.S. Cl.
CPC ..... *A47F 9/045* (2013.01); *B65D 43/20* (2013.01); *A47F 2009/041* (2013.01)

(58) Field of Classification Search
CPC ..... A47F 9/045; A47F 9/04; A47F 2009/041; B65D 43/20
See application file for complete search history.

(56) References Cited

U.S. PATENT DOCUMENTS 2,286,548 A * 6/1942 Jackson ..... A47F 9/045 312/140.1
2,653,723 A * 9/1953 Bergman ..... A24C 5/356 414/414
3,036,722 A * 5/1962 Sharaway ..... B62B 3/148 414/528
3,083,791 A * 4/1963 Shoffner ..... B62B 3/148 186/65
3,140,758 A * 7/1964 Ragnar ..... B62B 3/1484 186/64
3,196,984 A * 7/1965 Stout ..... A47F 9/045 186/65
3,298,568 A * 1/1967 Le Brocq ..... A47J 47/12 221/155
3,454,139 A * 7/1969 Lachance ..... A47F 9/045 186/64
3,792,757 A * 2/1974 Musser ..... A47F 9/04 186/64
4,007,809 A * 2/1977 Goransson ..... B62B 3/1484 186/63
4,353,564 A * 10/1982 Joseloff ..... A47F 9/045 186/63
4,373,611 A * 2/1983 Frederick ..... A47F 9/045 186/64
5,385,358 A * 1/1995 Adamson ..... B62B 3/148 280/33.995
5,388,667 A * 2/1995 Sonnendorfer ..... A47F 9/045 186/64
8,540,273 B2 * 9/2013 Dobrachinski ..... B62B 3/027 280/47.34
2005/0012286 A1 * 1/2005 Woodrow ..... A47F 9/045 280/47.35

* cited by examiner

*Primary Examiner* — Christopher R Harmon

(57) ABSTRACT

A shopping bin which mounts crosswise on a shopping cart and is slidable onto the conveyor belt of a supermarket check stand. The bin mechanism holds the bottom of the bin in place and causes a door at the front of the bin to open as the conveyor belt moves the rest of the bin forward until the bottom of the bin has been mostly extracted, thus allowing the check stand conveyor to completely vacate the contents of the bin and send them to the checker and the item scanner.

3 Claims, 3 Drawing Sheets

CHECK STAND CONVEYOR BELT BOTTOM EXTRACTED SHOPPING BIN

FIELD OF THE INVENTION AND OBJECT OF THE INVENTION

The field of the invention is shopping and the object of the invention is to provide a shopping bin which relieves the shopper from the burden of having to manually unload the items from a shopping cart and depositing them on the conveyor of a supermarket check stand. Another object of the invention is to provide such a bin that requires the very minimum of modifications to a conventional bin for this invention to perform its duty. A further object of the invention is to provide such a bin that can be stacked one inside the other in nesting fashion and therefore require minimal storage space. A still further object of the invention is to provide such a bin that in operation requires absolutely no modification to existing shopping carts or to existing check stands.

SUMMARY OF THE INVENTION INCLUDING BACKGROUND AND PRIOR ART

As technology has evolved the general trend in shopping market layout has been toward conveyor belt check stands with most stores requiring the customers to unload items from their shopping carts onto the belt which then moves the items to the checker who manually passes the items by a scanner for identification and pricing. One of the problems with such a system is that most customers would prefer not to be burdened by the task of unloading each item from their cart. Another related problem from the customer's perspective is that while they are occupied by the task of unloading the cart their attention is diverted from the register display showing prices as the checker scans items. A problem with the system from the stores perspective is often evident when an elderly or otherwise physically handicapped customer cannot keep up with the conveyor/checker and thus impedes throughput. Some shoppers place a hand carried basket of items on the conveyor which simply transfers the burden of item removal to the checker.

The desire to eliminate the current inefficiencies led to the invention of the Check Stand Conveyor Vacated Shopping Bin by this inventor (U.S. patent application Ser. No. 14/999,861) and this invention, the Check Stand Conveyor Belt Bottom Extracted Shopping Bin. Envisioned is a nested stack of bins available to the customers as they access their shopping carts. The bin is placed crosswise on the top of the cart leaving room for the placement of bulk items into the cart. The customer then places all the desired smaller items into the bin.

At the check stand the customer simply slides the bin onto the check stand conveyor belt. Thus the customer does not have to lift the weight of the bin and its contents.

In the preferred embodiment of this invention the bottom of the bin is slidable to a position substantially outside of the bin and has an angle bracket underneath at the rear which lips over the back of the conveyor table and thus holds the bottom in place as the rest of the bin moves forward with the conveyor. An upward rotating door at the front of the bin has a spring loaded hinge(s) and is held closed by the presence of the bin bottom. Thus when the bottom is extracted the door pops open as the contained items are deposited on the conveyor and moved by the conveyor to the checker. When the bin is empty the checker can simply lift and tilt the bin which returns the bottom and re-locks the door allowing the bin to be placed in a nesting stack.

Several inventions have taught how to make check stand operation more efficient. These include U.S. Pat. No. 3,036,722 (Sharaway), U.S. Pat. No. 3,306,398 (LaChance), U.S. Pat. No. 3,924,709 (Swanson), U.S. Pat. No. 3,446,315 (Close), and U.S. Pat. No. 4,373,611 (Frederick), all of which incorporate a separate conveyor inside a cart and none of which simply use the existing check stand conveyor to empty a bin. U.S. Pat. No. 4,043,426 (Verkler) teaches a cart with a basket that is slidable to the checker. It also does not use the check stand conveyor belt for evacuation and still requires individual items to be manually extracted from the basket. As a matter of fact the Verkler patent is intended for a check stand which does not even have a conveyor, a rarity in today's technology. The Verkler patent also requires a specialized cart. A distinct advantage of the bin of this invention besides not requiring a special conveyor is that contrary to the Verkler patent it does not require a specialized cart. The Swanson patent (U.S. Pat. No. 3,924,709) requires a complicated and expensive bin with a built-in conveyor and does not use the check stand conveyor belt but rather dictates that a special roller drive system be added to the check stand, a requirement that the current chains of supermarkets would highly object to. The Swanson invention also is intended for the currently rare check stand that doesn't even have a conveyor. Musser (U.S. Pat. No. 3,792,757) discloses a highly modified cart that slides over a likewise highly modified conveyor system.

All cited approaches require an expensive cart and extensive modifications to the check stand. The customer is required to position the cart correctly for unloading. Either all bulk items must go through the same unloading and scanning procedure, cumbersome at best, or a separate special procedure would be needed. The slidable basket version is further restricted by a trade-off between capacity and distance the checker must reach for items.

The only invention to the knowledge of this inventor which utilizes the existing check stand conveyor for unloading items from a shopping bin is the Check Stand Conveyor Vacated Shopping Bin (application Ser. No. 14/999,861) by this inventor (McLees), That invention uses the conveyor to advance the bin until a tab on the front door of the bin breaks the photo beam (normally used to stop the conveyor when an item arrives at the checker) near the end of the conveyor nearest the scanner and thereby stops the conveyor and the bin. When the checker opens the front door of the bin the photo beam is revealed thus re-activating the conveyor as the bin is held in place by a simple bin stop added to the check table. An evacuating plunger attached through slots in the bottom of the bin to rails underneath the bin which rest on the moving conveyor pushes the items inside of the bin to the front of the bin until they break the photo beam thus stopping the conveyor until removal and scanning by the checker.

While this approach is quite effective it does have a few drawbacks relative to the new improved bin which is the subject of this disclosure. The original McLees bin structure is fairly complex and could be relatively expensive to manufacture. The checker is required to manually open the bin door while with the bottom extracted bin the door opening is entirely automatic and the checker is required to do nothing during the scanning process beyond what is required if the bin were not there. Also in the original McLees bin the checker may be required to reach over the side of the bin to access some items while the arm/hand movement of simply grasping the item and moving it over the scanner as is the case with the bottom extracted bin is more efficient. Also the check stand requires the slight modification of the addition of the bin hold while the bottom extracted bin requires no additional modification of any kind to the shopping carts or the check stands, an appealing aspect from the standpoint of store managers. The evacuating plunger of the original McLees bin pushing possibly heavy items against possibly fragile items behind more heavy items is certainly less desirable than the bottom extracted bin which simply deposits the items on the conveyor as the conveyor carries away any fragile item from any heavy item behind it that would still be on the bin bottom as the bottom is being extracted.

DETAILED DESCRIPTION OF THE DRAWINGS

Figure 1:
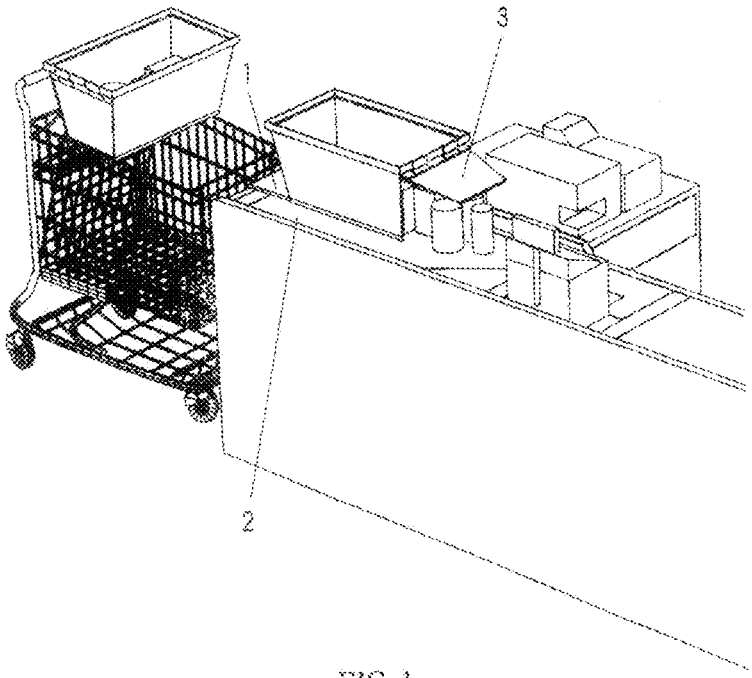
FIG. 1 shows one bin cross-mounted on a cart prior to unloading and a second bin on the check stand conveyor in the process of having its contents unloaded by the check stand conveyor belt.

In FIG. 1 it can be seen that the shopping cart is about the same height as the check stand table so there is no need for the customer to lift the bin. Rather it is simply slid and rotated partially onto the check stand conveyor (2) and the conveyor then moves the bin into its unload position. The bin on the conveyor in FIG. 1 has been moved forward by the conveyor (2) while the bottom (1) of the bin is being held in place at the end of the check stand table. At this point the bottom (1) has been extracted enough to release the bin door (3) which is shown popped open and the bin's contents can be seen exiting out the front of the bin to the checker.

Figure 2:
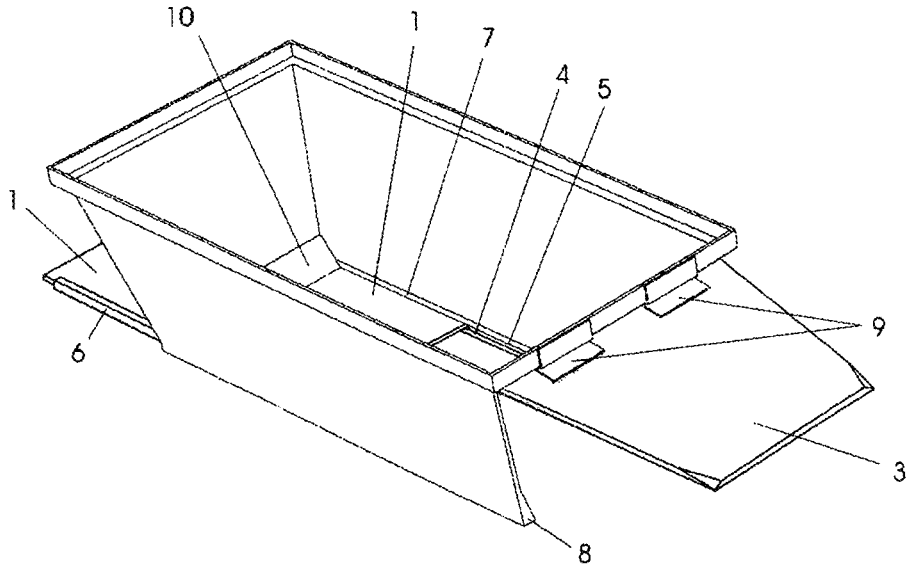
FIG. 2 is a detailed drawing of inside the bin as viewed from the door end.

The preferred embodiment is illustrated in FIG. 2. In this figure the bin of FIG. 1 in the unload position is shown in greater detail. The bottom (1) rides on rails (4) which are spaced from the bin sides to form a slot (5) on each side of the bin. Bottom side slats (6) ride in the slots (5) and a slanted side baffle on each side of the bin hold the bottom down as well as preventing items in the bin from hanging up on the rails (4). When the bottom (1) is in its fully forward position the slats (6) in the slots (5) hold the bin sides together with a tab (8) on each side overlapping the closed door and thus prevent it from opening. However when the bottom is extracted by the conveyor moving the bin forward the lower portions of the bin sides are freed to spread apart. The spring force of the spring loaded hinges (9) then pop the door (3) open. Bottom stops (not shown) prevent the bottom (1) from completely exiting the bin so that when the bin is emptied the checker simply closes the door and tilts the bin up which returns the bottom thus locking the door closed. The bin can then be placed in a nesting stack of bins. A back baffle (10) keeps items from hanging up on the portion of the bottom when the bottom is in its fully extracted position.

While this is the preferred embodiment it should be herein noted that the bin need not even have a door. After the bottom has been extracted the customer or the checker can simply lift the bin shell and the still attached bottom up off the conveyor, thus depositing the bin contents on the conveyor. The problem with this approach is that the items are not deposited in an orderly fashion and it is possible for some items to hang up in the bin and then drop a considerable distance which would be a bad scenario for things like eggs. However such a bin could be acceptable in some retail outlet for non-food or non-breakable items.

Also in this preferred embodiment there are other ways to keep the sides together at the front thus locking the door closed besides bottom slats in continuous slots the length of the bin. However if the slats were not there the items in a heavily loaded bin could force the bin sides to expand out allowing the bin bottom to slip down between the rails onto the conveyor. If the rails were wider to prevent this the likelihood of items hanging up on the rails is greatly increased, so the logical solution is the preferred embodiment illustrated in FIG. 2.

It should also be noted that while the preferred embodiment releases the door automatically the door could be released manually. There could be applications wherein it would be advantages for the door to keep the contents contained until manual release by the checker.

Figure 3:
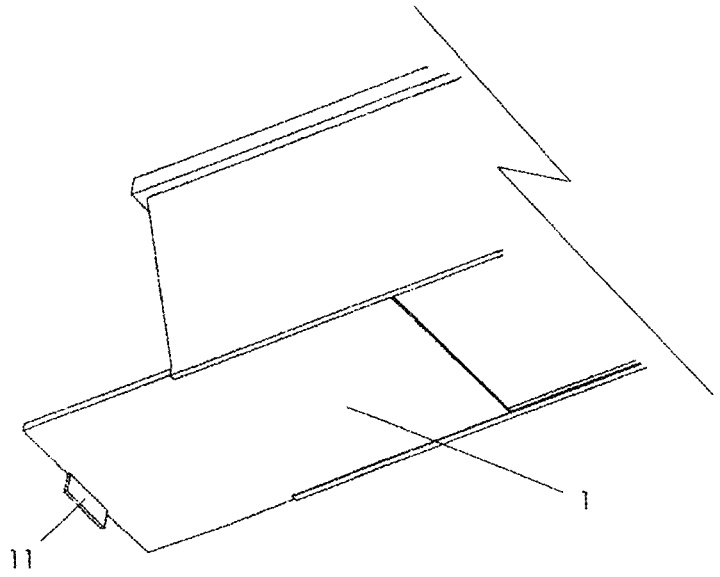
FIG. 3 is a partial simplified isometric of the underside of the bin also as viewed from the door end.

FIG. 3 is a partial simplified isometric of the underneath of the bin showing the bottom hold (11) which holds the bottom (1) at the rear of the check stand while the conveyor moves the rest of the bin forward.

What is claimed is:

1. A shopping bin comprising a front portion, a rear back portion, two sides and a slidable bottom in operable combination with a supermarket check stand table, its conveyor belt, item scanner and checker, said bin bottom being slidable to the rear of said bin to a position in which more than ninety percent of the surface area of said bottom resides to the rear of said bin and said bin bottom having a downward protruding tab at the rear of said bin bottom which engages the leading edge of said check stand table thus holding said slidable bin bottom in place while said check stand conveyor belt moves said bin toward said check stand scanner and checker causing the contents of said bin to be deposited upon said conveyor belt.

2. The shopping bin of claim 1 having a spring loaded hinged front door extending substantially across the width and height of said bin.

3. The shopping bin of claim 1 having a spring loaded hinged front door extending substantially across the width and height of said bin, the sides of said slidable bin bottom having slats in sliding communication with slots in said bin sides and said bin sides having tabs at the bottom of said sides overlapping the bottom of said bin door, said bin sides being flexible and allowing release of said spring loaded hinged bin door upon rearward movement of said slidable bin bottom which allows said flexible bin sides to spread apart.

* * * * *